US010400361B2

(12) United States Patent
Takashima

(10) Patent No.: US 10,400,361 B2
(45) **Date of Patent: *Sep. 3, 2019**

(54) THREAD PRODUCTION DEVICE, AND AGGREGATING PART

(71) Applicant: MURATA MACHINERY, LTD., Kyoto-shi, Kyoto (JP)

(72) Inventor: Hiroki Takashima, Kyoto (JP)

(73) Assignee: MURATA MACHINERY, LTD., Kyoto (JP)

( * ) Notice: Subject to any disclaimer, the term of this patent is extended or adjusted under 35 U.S.C. 154(b) by 536 days.

This patent is subject to a terminal disclaimer.

(21) Appl. No.: 14/905,225

(22) PCT Filed: Jul. 22, 2013

(86) PCT No.: PCT/JP2013/069814

§ 371 (c)(1),
(2) Date: Jan. 14, 2016

(87) PCT Pub. No.: WO2015/011769

PCT Pub. Date: Jan. 29, 2015

(65) Prior Publication Data

US 2016/0153125 A1 Jun. 2, 2016

(51) Int. Cl.
*D01H 5/72* (2006.01)
*D02G 3/16* (2006.01)
(Continued)

(52) U.S. Cl.
CPC ..... *D01H 5/72* (2013.01); *B65H 51/015* (2013.01); *B65H 54/2896* (2013.01);
(Continued)

(58) Field of Classification Search
CPC . D01H 1/115; D02G 3/16; D02G 3/22; D10B 2101/122
(Continued)

(56) References Cited

U.S. PATENT DOCUMENTS 3,563,017 A * 2/1971 Lutjen ..... D07B 7/14 57/13
6,601,880 B2 * 8/2003 Marois ..... B65B 11/025 289/1.5
(Continued)

FOREIGN PATENT DOCUMENTS

DE 206264 C 5/1908
JP 2001-155567 A 6/2001
(Continued)

OTHER PUBLICATIONS

Wang, X. et al.; "Technology for Preparation of NanoFiber"; State Key Laboratory for Modification of Chemical Fibers and Polymer Materials; vol. 17; Sep. 30, 2003; 4 pages.
(Continued)

*Primary Examiner* — Shaun R Hurley
*Assistant Examiner* — Bao-Thieu L Nguyen
(74) *Attorney, Agent, or Firm* — Keating & Bennett, LLP

(57) ABSTRACT

A yarn producing apparatus produces CNT (carbon nanotube) yarn from CNT fibers while causing the CNT fibers to run. The yarn producing apparatus includes an aggregating unit that aggregates the CNT fibers, and a twisting and winding device that twists the CNT fibers aggregated by the aggregating unit. The aggregating unit includes an adjusting mechanism that adjusts the aggregation state of the CNT fibers.

20 Claims, 7 Drawing Sheets

(51) Int. Cl.

| | |
|---|---|
| ***D01F 9/127*** | (2006.01) |
| ***B65H 51/015*** | (2006.01) |
| ***B65H 54/28*** | (2006.01) |
| ***D01G 99/00*** | (2010.01) |
| ***D01H 1/14*** | (2006.01) |
| ***D01H 13/04*** | (2006.01) |
| ***D01H 1/04*** | (2006.01) |

(52) U.S. Cl.
CPC ..... *D01F 9/127* (2013.01); *D01G 99/00* (2013.01); *D01H 1/04* (2013.01); *D01H 1/14* (2013.01); *D01H 13/04* (2013.01); *D02G 3/16* (2013.01); *B65H 2701/314* (2013.01); *D10B 2101/122* (2013.01)

(58) Field of Classification Search
USPC ..... 57/138, 352, 353
See application file for complete search history.

(56) References Cited

U.S. PATENT DOCUMENTS

| | | | | |
|---|---|---|---|---|
| 8,720,174 | B2 * | 5/2014 | Kochmann ..... | D02G 3/46 57/224 |
| 2002/0113335 | A1 | 8/2002 | Lobovsky et al. | |
| 2008/0170982 | A1 * | 7/2008 | Zhang ..... | B82Y 10/00 423/447.3 |
| 2016/0160401 | A1 * | 6/2016 | Takashima ..... | D01H 1/115 57/333 |

FOREIGN PATENT DOCUMENTS

| | | | |
|---|---|---|---|
| JP | 3954967 | B2 | 8/2007 |
| JP | 2009-166967 | A | 7/2009 |
| JP | 2010-116632 | A | 5/2010 |

OTHER PUBLICATIONS

Tran et al., "Improving the tensile strength of carbon nanotube spun yarns using a modified spinning process", Carbon, vol. 47, No. 11, May 27, 2009, pp. 2662-2670.

Miao et al., "Poisson's ratio and porosity of carbon nanotune dry-spun yarns", Carbon, vol. 48, No. 10, Apr. 10, 2010, pp. 2802-2811.

Jayasinghe et al. "Spinning yarn from long carbon nanotube arrays", Journal of Material Search, vol. 26, No. 5, Dec. 28, 2011, pp. 645-651.

* cited by examiner

*Fig.4* A
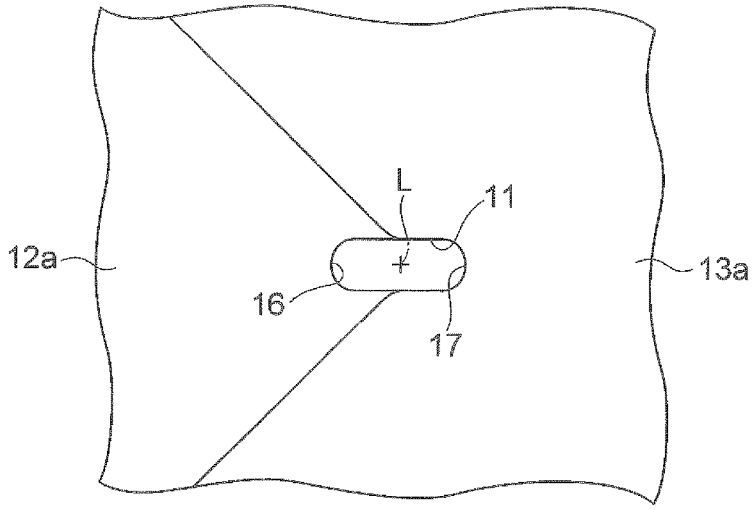
Fig.4B
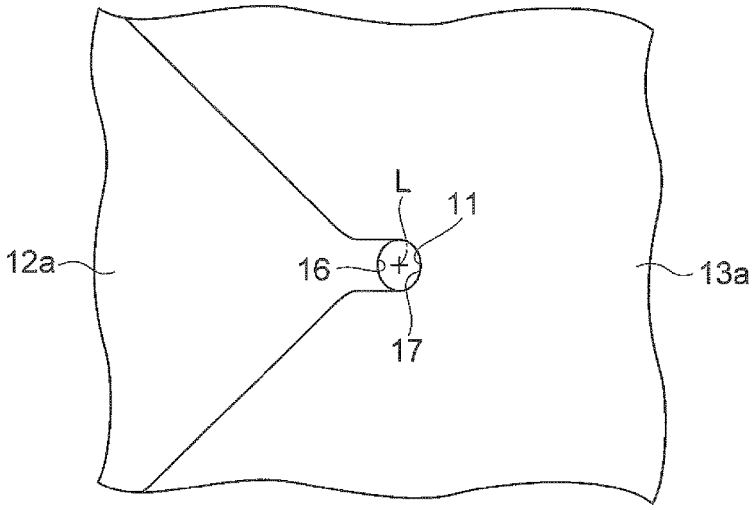

THREAD PRODUCTION DEVICE, AND AGGREGATING PART

BACKGROUND OF THE INVENTION

1. Field of the Invention

The present invention relates to a yarn producing apparatus for producing carbon nanotube yarn from carbon nanotube fibers while causing the carbon nanotube fibers to run, and an aggregating unit applicable to the yarn producing apparatus.

2. Description of the Related Art

A known example of a yarn producing apparatus as described above includes holding means for aggregating carbon nanotube fibers pulled out from a carbon nanotube forming substrate and twisting means for twisting the carbon nanotube fibers aggregated by the holding means (see, for example, Japanese Patent Application Laid-Open Publication No. 2010-116632).

Japanese Patent No. 3954967 (FIG. 4) discloses spinnerets or nozzles for creating alignment of the suspended nanotube arrays. The spinnerets or nozzles allow a significant increase in the intensity of the extensional flow in the nanotube suspension with an accompanying increase in the degree of carbon nanotube alignment.

In the yarn producing apparatus described in Japanese Patent Application Laid-Open Publication No. 2010-116632, a pair of rotatable rollers is used as the holding means for aggregating carbon nanotube fibers. For this reason, for example, when the amount of carbon nanotube fibers drawn from the carbon nanotube forming substrate varies, the aggregation state of the carbon nanotube fibers may become unstable, and, as a result, the strength or appearance of the produced carbon nanotube yarn may be insufficient. In order to produce carbon nanotube yarn having sufficient strength with the spinnerets or nozzles described in Japanese Patent No. 3954967, the spinnerets or nozzles have to be replaced each time depending on a desired thickness of carbon nanotube yarn.

SUMMARY OF THE INVENTION

Preferred embodiments of the present invention provide a yarn producing apparatus capable of producing carbon nanotube yarn with sufficient strength and an aggregating unit applicable to a yarn producing apparatus.

A yarn producing apparatus according to a preferred embodiment of the present invention produces carbon nanotube yarn from carbon nanotube fibers while causing the carbon nanotube fibers to run. The yarn producing apparatus includes an aggregating unit that aggregates the carbon nanotube fibers and a twisting unit that twists the carbon nanotube fibers aggregated by the aggregating unit. The aggregating unit includes an adjusting mechanism that adjusts an aggregation state of the carbon nanotube fibers.

In this yarn producing apparatus, when the aggregating unit aggregates the carbon nanotube fibers, the adjusting mechanism adjusts the aggregation state of the carbon nanotube fibers. With this unique structure, the carbon nanotube fibers are stably aggregated, for example, even when the amount of carbon nanotube fibers varies. A desired tension, therefore, is exerted on the aggregated carbon nanotube fibers when the twisting unit twists the carbon nanotube fibers. This yarn producing apparatus thus produces carbon nanotube yarn with sufficient strength.

In a yarn producing apparatus according to a preferred embodiment of the present invention, the aggregating unit may aggregate the carbon nanotube fibers while exerting a force on the carbon nanotube fibers in a direction vertical to a direction of the carbon nanotube fibers running. With this unique structure, when the aggregating unit aggregates the carbon nanotube fibers, a resistive force is exerted on the carbon nanotube fibers against the running. For this reason, the carbon nanotube fibers are twisted densely in the twisting unit.

In a yarn producing apparatus according to a preferred embodiment of the present invention, the aggregating unit may aggregate the carbon nanotube fibers while exerting the force on the carbon nanotube fibers by causing the carbon nanotube fibers to pass through a through hole in contact with the through hole. With this unique structure, exertion of a resistive force on the carbon nanotube fibers and aggregation of the carbon nanotube fibers are accomplished with a simple structure.

In a yarn producing apparatus according to a preferred embodiment of the present invention, the aggregating unit may further include a plurality of assembly parts that define the through hole. The adjusting mechanism may adjust the aggregation state of the carbon nanotube fibers by adjusting a positional relation between the assembly parts and adjusting an opening area of the through hole. With this unique structure, the magnitude of resistive force exerting on the carbon nanotube fibers and the aggregation state of the carbon nanotube fibers is able to be adjusted as desired. For example, even when the carbon nanotube fibers clog the through hole, the carbon nanotube fibers are easily removed by dissembling the assembly parts.

In a yarn producing apparatus according to a preferred embodiment of the present invention, the aggregating unit may further include a first plate-shaped member and a second plate-shaped member as the assembly parts, the first plate-shaped member and the second plate-shaped member being provided with a first notch and a second notch respectively, the first notch and the second notch defining the through hole. The adjusting mechanism may adjust the opening area of the through hole by moving at least one of the first plate-shaped member and the second plate-shaped member and adjusting an overlapping state of the first notch and the second notch. With this unique structure, the opening area of the through hole is able to be adjusted easily and reliably.

In a yarn producing apparatus according to a preferred embodiment of the present invention, the aggregating unit may further include a plurality of wires and a plurality of holding pieces as the assembly parts, the wires defining the through hole, the holding pieces holding respective ends of the wires. The adjusting mechanism may adjust the opening area of the through hole by swinging each of the holding pieces and adjusting an overlapping state of the wires. With this unique structure, the opening area of the through hole is able to be adjusted easily and reliably.

A yarn producing apparatus according to a preferred embodiment of the present invention may further include a tensioning unit that acts on the carbon nanotube fibers running between the aggregating unit and the twisting unit and to apply tension to the carbon nanotube fibers to be twisted by the twisting unit. With this unique structure, tension at a desired value is able to be applied to the carbon nanotube fibers and the carbon nanotube fibers are twisted more densely in the twisting unit.

In a yarn producing apparatus according to a preferred embodiment of the present invention, the tensioning unit may be a pneumatic tensioning mechanism that blows air to the carbon nanotube fibers to exert force on the carbon nanotube fibers in a direction opposite to a direction of the carbon nanotube fibers running. With this unique structure, tension is appropriately applied to the carbon nanotube fibers without aggregating the carbon nanotube fibers more than necessary due to contact.

In a yarn producing apparatus according to a preferred embodiment of the present invention, the tensioning unit may be a gate-type tensioning mechanism that bends the carbon nanotube fibers by using comb tooth-shaped contact portions arranged alternately to exert a resistive force on the running carbon nanotube fibers. With this unique structure, tension is appropriately applied to the carbon nanotube fibers without aggregating the carbon nanotube fibers more than necessary.

A yarn producing apparatus according to a preferred embodiment of the present invention may further include an additional aggregating unit arranged between the aggregating unit and the twisting unit and that aggregates the running carbon nanotube fibers. This unique structure causes the carbon nanotube fibers to be aggregated step by step, so as to significantly reduce or prevent strain on the carbon nanotube fibers and thus disturbance in alignment (arrangement) of the carbon nanotube fibers.

A yarn producing apparatus according to a preferred embodiment of the present invention may further include a substrate support that supports a carbon nanotube forming substrate from which the carbon nanotube fibers are drawn. With this unique structure, the carbon nanotube fibers are stably supplied.

In a yarn producing apparatus according to a preferred embodiment of the present invention, the twisting unit may include a wind driving mechanism that causes a winding shaft provided with a winding tube to rotate about the winding centerline of the winding shaft to wind the carbon nanotube yarn onto the winding tube, a twist driving mechanism that causes a guide to rotate around the winding tube and guide the carbon nanotube yarn to the winding tube, to twist the carbon nanotube fibers and produce the carbon nanotube yarn while causing the carbon nanotube fibers, carbon nanotube yarn, or both to swirl, and a traverse driving mechanism that causes the guide to reciprocate relative to the winding tube along the winding centerline of the winding shaft to cause the carbon nanotube yarn to traverse the winding tube. With this unique structure, the carbon nanotube fibers, carbon nanotube yarn, or both are twisted and a balloon (the carbon nanotube fibers, carbon nanotube yarn, or both expanding like a balloon under centrifugal force) is formed, such that the balloon appropriately absorbs tension variations produced in the relatively less elastic carbon nanotube fibers, and the carbon nanotube fibers are twisted efficiently.

An aggregating unit according to a preferred embodiment of the present invention, in a yarn producing apparatus for producing carbon nanotube yarn from carbon nanotube fibers while causing the carbon nanotube fibers to run, aggregates the carbon nanotube fibers. The aggregating unit includes an adjusting mechanism that adjusts an aggregation state of the carbon nanotube fibers.

An aggregating unit according to a preferred embodiment of the present invention may aggregate the carbon nanotube fibers while exerting a force on the carbon nanotube fibers in a direction vertical to a direction of the carbon nanotube fibers running.

An aggregating unit according to a preferred embodiment of the present invention may aggregate the carbon nanotube fibers while exerting the force on the carbon nanotube fibers by causing the carbon nanotube fibers to pass through a through hole in contact with the through hole.

An aggregating unit according to a preferred embodiment of the present invention may further include a plurality of assembly parts that define the through hole. The adjusting mechanism may adjust the aggregation state of the carbon nanotube fibers by adjusting a positional relation between the assembly parts and adjusting an opening area of the through hole.

An aggregating unit according to a preferred embodiment of the present invention may further include a first plate-shaped member and a second plate-shaped member as the assembly parts, the first plate-shaped member and the second plate-shaped member being provided with a first notch and a second notch respectively, the first notch and the second notch defining the through hole. The adjusting mechanism may adjust the opening area of the through hole by moving at least one of the first plate-shaped member and the second plate-shaped member and adjusting an overlapping state of the first notch and the second notch.

An aggregating unit according to a preferred embodiment of the present invention may further include a plurality of wires and a plurality of holding pieces as the assembly parts, the wires defining the through hole, the holding pieces holding respective ends of the wires. The adjusting mechanism may adjust the opening area of the through hole by swinging each of the holding pieces and adjusting an overlapping state of the wires.

Various preferred embodiments of the present invention provide a yarn producing apparatus capable of producing carbon nanotube yarn with sufficient strength and an aggregating unit applicable to the yarn producing apparatus.

The above and other elements, features, steps, characteristics and advantages of the present invention will become more apparent from the following detailed description of the preferred embodiments with reference to the attached drawings.

BRIEF DESCRIPTION OF THE DRAWINGS

FIGS. 4A and 4B are enlarged views of the main portions of the first and second plate-shaped members in FIG. 3.

DETAILED DESCRIPTION OF THE PREFERRED EMBODIMENTS

Preferred embodiments of the present invention will be described in details below with reference to the figures. It should be noted that the same or corresponding elements and portions in the figures are denoted with the same reference signs and an overlapping description will be omitted.

Figure 1:
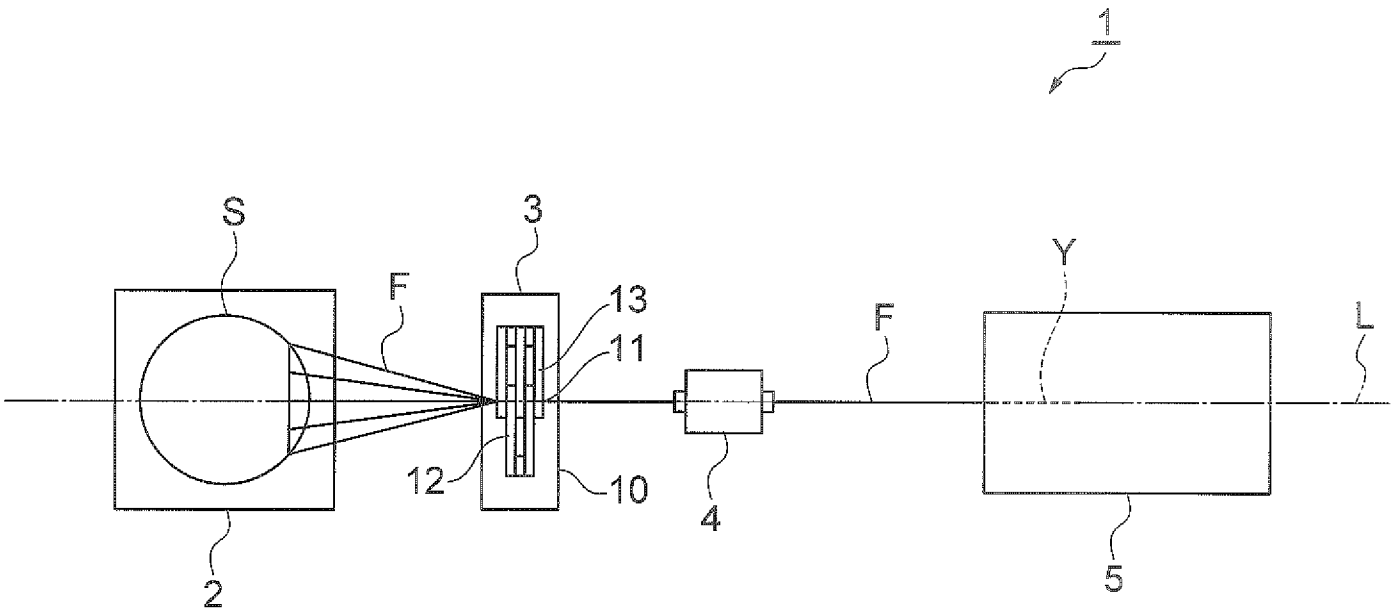
FIG. 1 is a plan view of a yarn producing apparatus according to a preferred embodiment of the present invention.

As shown in FIG. 1, a yarn producing apparatus 1 is an apparatus that produces carbon nanotube yarn (hereinafter referred to as "CNT yarn") Y from carbon nanotube fibers (hereinafter referred to as "CNT fibers") F while causing the CNT fibers F to run. The yarn producing apparatus 1 includes a substrate support 2, an aggregating unit 3, a tensioning unit 4, and a twisting and winding device (twisting unit) 5. The substrate support 2, the aggregating unit 3, the tensioning unit 4, and the twisting and winding device 5 are arranged in this order on a predetermined straight line L. The CNT fibers F run from the substrate support 2 toward the twisting and winding device 5. The CNT fibers F are a set of a plurality of fiber threads (fibers) of carbon nanotube. The CNT yarn Y is the twisted (genuine-twisted or false-twisted) CNT fibers F.

The substrate support 2 supports a carbon nanotube forming substrate (hereinafter referred to as "CNT forming substrate") S from which the CNT fibers F are drawn, in a state of holding the CNT forming substrate S. The CNT forming substrate S is called a carbon nanotube forest or a vertically aligned carbon nanotube structure in which high-density and highly-oriented carbon nanotubes (for example, single-wall carbon nanotubes, double-wall carbon nanotubes, or multi-wall carbon nanotubes) are formed on a substrate by chemical vapor deposition or any other process. Examples of the substrate include a glass substrate, a silicon substrate, and a metal substrate. For example, at the start of production of the CNT yarn Y or during replacement of the CNT forming substrates S, a tool called a microdrill can be used to draw the CNT fibers F from the CNT forming substrate S. In place of a microdrill, a suction device, an adhesive tape, or any other elements or tools may be used to draw the CNT fibers F from the CNT forming substrate S.

The aggregating unit 3 aggregates the CNT fibers F while exerting a force on the CNT fibers F in a direction vertical to the direction of the CNT fibers F running when the CNT fibers F drawn from the CNT forming substrate S run toward the twisting and winding device 5. More specifically, the aggregating unit 3 aggregates the CNT fibers F to such an extent that the CNT fibers F are able to be twisted in the subsequent stage.

The aggregating unit 3 includes a plurality of first plate-shaped members 12 and a plurality of second plate-shaped members 13 as assembly parts that define a through hole 11 that the CNT fibers F pass through in contact with the through hole 11. The aggregating unit 3 further includes an adjusting mechanism 10 that adjust the aggregation state of the CNT fibers F. The adjusting mechanism 10 adjusts the aggregation state of the CNT fibers F by adjusting the positional relation between the first plate-shaped members 12 and the second plate-shaped members 13 and adjusting the opening area of the through hole 11.

Figure 2:
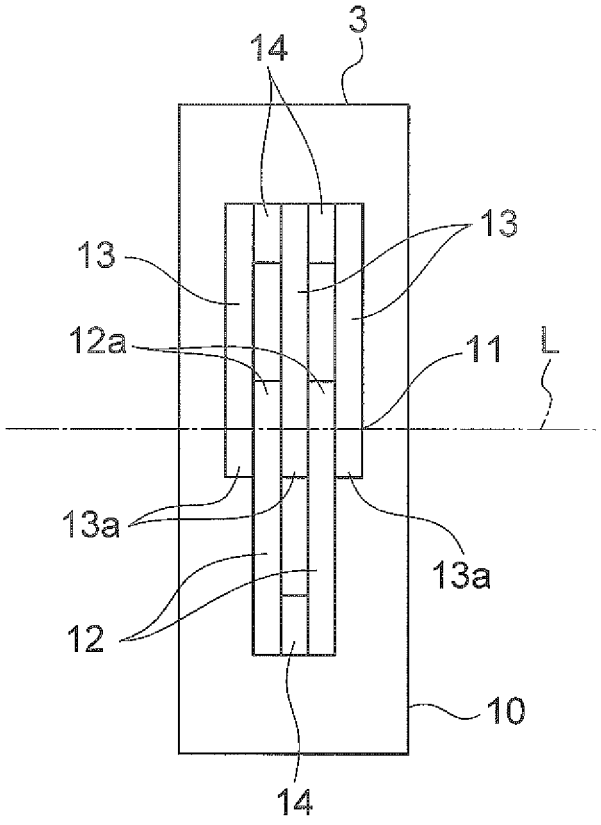
FIG. 2 is a plan view of an aggregating unit in the yarn producing apparatus in FIG. 1.

A plurality of (for example, two) first plate-shaped members 12 are attached at a predetermined distance from each other to the adjusting mechanism 10 on one side of the predetermined line L. A plurality of (for example, three) second plate-shaped members 13 are attached at a distance from each other to the adjusting mechanism 10 on the other side of the predetermined line L. As shown in FIG. 2, the adjusting mechanism 10 advances and retreats the tip end portion 12*a* of each first plate-shaped member 12 and the tip end portion 13*a* of each second plate-shaped member 13 to/from the predetermined line L, so that the tip end portions 12*a* and the tip end portions 13*a* are arranged alternately on the predetermined line L. Spacers 14 that maintain a predetermined distance are interposed between the adjacent first plate-shaped members 12 and between the adjacent second plate-shaped members 13.

Figure 3:
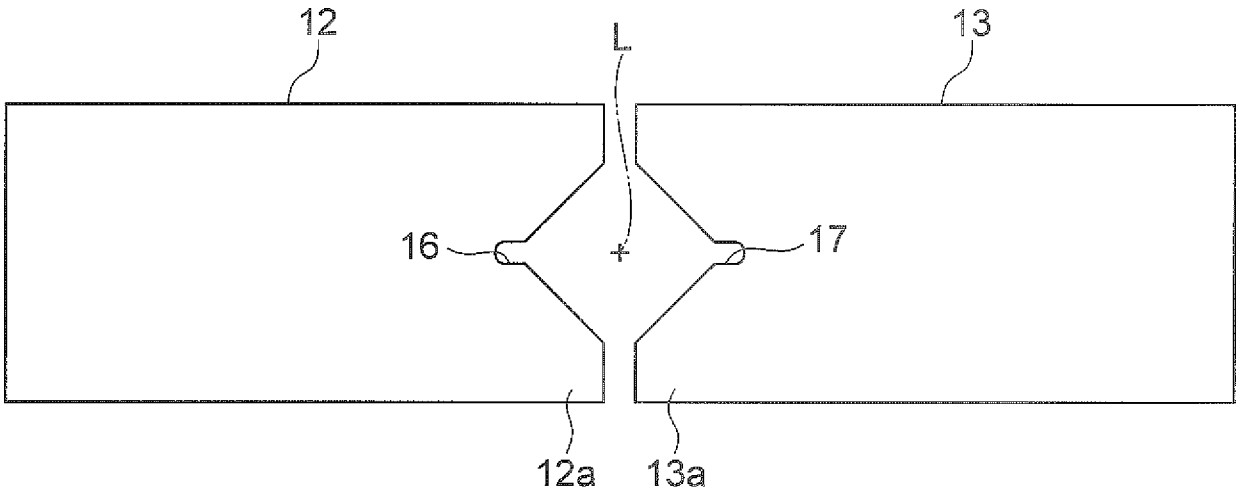
FIG. 3 is a front view of first and second plate-shaped members of the aggregating unit in FIG. 2.

As shown in FIG. 3, the tip end portion 12*a* of the first plate-shaped member 12 is provided with a first notch 16 opening to the predetermined line L. The tip end portion 13*a* of the second plate-shaped member 13 is provided with a second notch 17 opening to the predetermined line L. As shown in FIGS. 4A and 4B, the region where the first notch 16 and the second notch 17 overlap each other on the predetermined line L (for example, an oval region as shown in FIG. 4A or a circular region as shown in FIG. 4B) defines and functions as the through hole 11 that the CNT fibers F pass through in contact with the through hole 11. That is, the first notch 16 and the second notch 17 define the through hole 11.

The adjusting mechanism 10 adjusts the opening area of the through hole 11 by advancing and retreating the tip end portion 12*a* of each first plate-shaped member 12 and the tip end portion 13*a* of each second plate-shaped member 13 to/from the predetermined line L and adjusting the overlapping state of the first notch 16 and the second notch 17 on the predetermined line L. With this unique structure, the adjusting mechanism 10 adjusts the aggregation state of the CNT fibers F. For example, the CNT fibers F are aggregated more densely as the opening area of the through hole 11 decreases. As the opening area of the through hole 11 decreases, the resistive force exerting on the running CNT fibers F increases, so that the tension in the CNT fibers F is able to be increased on the downstream side from the aggregating unit 3.

As shown in FIG. 1, the tensioning unit 4 applies tension to the CNT fibers F running between the aggregating unit 3 and the twisting and winding device 5. More specifically, the tensioning unit 4 is a pneumatic tensioning mechanism that blows air to the CNT fibers F toward the upstream side in the direction of the CNT fibers F running (hereinafter simply referred to as "upstream side") to exert force on the CNT fibers F in the direction opposite to the direction of the CNT fibers F running, on the downstream side in the direction of the CNT fibers F running (hereinafter simply referred to as "downstream side"). The tensioning unit 4 may be a gate-type tensioning mechanism that bends the CNT fibers F by using comb tooth-shaped contact portions arranged alternately to exert force on the CNT fibers F in the direction opposite to the direction of the CNT fibers F running. Alternatively, the tensioning unit 4 may be a disk-type tensioning mechanism or any other tensioning mechanism.

Figure 5:
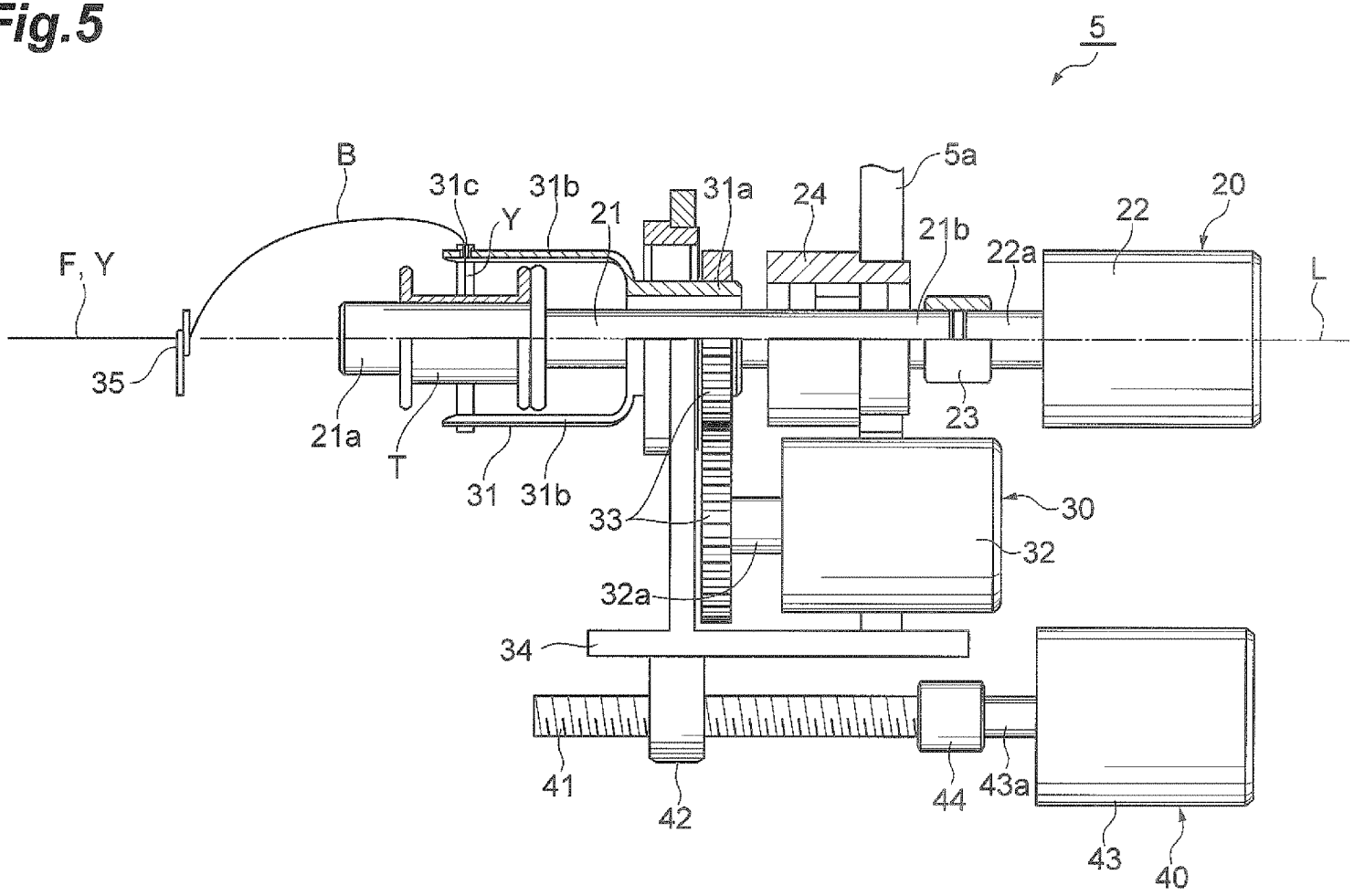
FIG. 5 is a partial cross-sectional view of a twisting and winding device in the yarn producing apparatus in FIG. 1.

The twisting and winding device 5 winds the produced CNT yarn Y onto a winding tube while twisting the CNT fibers F aggregated by the aggregating unit 3. More specifically, as shown in FIG. 5, the twisting and winding device 5 includes a wind driving mechanism 20 that winds the CNT yarn Y onto a winding tube T, a twist driving mechanism 30 that twists the CNT fibers F and producing the CNT yarn Y while forming a balloon B of the CNT fibers F, CNT yarn Y, or both, and a traverse driving mechanism 40 that causes the CNT yarn Y to traverse the winding tube T.

The wind driving mechanism 20 includes a winding shaft 21 having the winding centerline on the predetermined line L and a wind driving motor 22 that rotates the winding shaft 21. The winding tube T is attached to a tip end portion 21*a* that is the upstream end of the winding shaft 21, and is removable from the winding shaft 21. A base end portion 21*b* that is the downstream end of the winding shaft 21 is coupled to the drive shaft 22*a* of the wind driving motor 22 with a shaft coupling 23. The winding shaft 21 is supported on a frame 5*a* of the twisting and winding device 5 with a bearing 24. The wind driving motor 22 is fixed to the frame 5*a*. The wind driving mechanism 20 as described above winds the CNT yarn Y onto the winding tube T by driving the wind driving motor 22 so that the winding shaft 21 provided with the winding tube T is rotated about the winding centerline (that is, the predetermined line L).

The twist driving mechanism 30 includes a guide 31 that guides the CNT yarn Y to the winding tube T and a twist driving motor 32 that rotates the guide 31 around the winding tube T. The guide 31 includes a tubular body 31*a* surrounding the winding shaft 21 and a pair of arms 31*b* extending on the upstream side from the body 31*a*. A tip end portion that is the upstream end of one arm 31*b* includes an insertion hole 31*c* through which the CNT yarn Y is inserted to be guided to the winding tube T. The CNT yarn Y to be inserted through the insertion hole 31*c* is passed through a guide ring 35 arranged on the predetermined line L in a state of the CNT fibers F, CNT yarn Y, or both, and guided to the winding tube T. The body 31*a* of the guide 31 is coupled to the drive shaft 32*a* of the twist driving motor 32 with a plurality of spur gears 33. The guide 31, the twist driving motor 32, and the spur gear 33 are supported by a stage 34 attached to the frame 5*a* so as to be able to reciprocate along the predetermined line L. For example, a bush defining and functioning as a slide bearing may be disposed between the winding shaft 21 and the body 31*a*. The twist driving mechanism 30 as described above twists the CNT fibers F and produces the CNT yarn Y while causing the CNT fibers F, CNT yarn Y, or both to swirl on the guide ring 35 defining and functioning as a fulcrum, by driving the twist driving motor 32 so that the guide 31 that guides the CNT yarn Y to the winding tube T is rotated around the winding tube T. The term "the CNT fibers F, CNT yarn Y, or both" inclusively means the CNT fibers F in a raw state, the CNT fibers F twisted into the CNT yarn Y, and the intermediate therebetween.

The traverse driving mechanism 40 includes a ball screw shaft 41 having the centerline parallel or substantially parallel to the predetermined line L, a ball screw nut 42 screwed onto the ball screw shaft 41, and a traverse driving motor 43 that rotates the ball screw shaft 41. A base end portion that is the downstream end of the ball screw shaft 41 is coupled to the drive shaft 43*a* of the traverse driving motor 43 with a shaft coupling 44. The ball screw nut 42 is fixed to the stage 34 of the twist driving mechanism 30. The traverse driving motor 43 is fixed to the frame 5*a*. The traverse driving mechanism 40 as described above causes the CNT yarn Y to traverse the winding tube T by driving the traverse driving motor 43 so that the ball screw shaft 41 is rotated in the positive direction and the negative direction and the twist driving mechanism 30 reciprocates along the predetermined line L (that is, the guide 31 reciprocates relative to the winding tube T along the winding centerline of the winding shaft 21). In order to cause the CNT yarn Y to traverse the winding tube T, for example, the winding tube T may reciprocate relative to the guide 31 along the winding centerline of the winding shaft 21 as long as the guide 31 is able to reciprocate relative to the winding tube T along the winding centerline of the winding shaft 21.

As described above, in the yarn producing apparatus 1, when the aggregating unit 3 aggregates the CNT fibers F, the adjusting mechanism 10 adjusts the aggregation state of the CNT fibers F. With this unique structure, for example, even when the amount of the CNT fibers F drawn from the CNT forming substrate S varies, the CNT fibers F are stably aggregated. The aggregated CNT fibers F therefore are subjected to a desired tension when the CNT fibers F are twisted in the twisting and winding device 5. The yarn producing apparatus 1 thus produces CNT yarn Y having sufficient strength.

More specifically, the adjusting mechanism 10 is able to advance and retreat the tip end portion 12*a* of each first plate-shaped member 12 and the tip end portion 13*a* of each second plate-shaped member 13 to/from the predetermined line L, based on the amount of the CNT fibers F detected by a separate sensor, such that the opening area of the through hole 11 increases as the amount of the CNT fibers F increases. The aggregating unit 3 may include a biasing member such as a spring such that the tip end portion 12*a* of each first plate-shaped member 12 and the tip end portion 13*a* of each second plate-shaped member 13 move away from the predetermined line L when a force is exerted in the direction vertical to the direction of the CNT fibers F running. This unique structure prevents disorder in alignment (arrangement) of the CNT fibers F even when the amount of the CNT fibers F abruptly increases. This unique structure also prevents clogging of the aggregating unit 3 with the CNT fibers F and thus breakage of the CNT fibers F.

In the yarn producing apparatus 1, the aggregating unit 3 aggregates the CNT fibers F while exerting a force on the CNT fibers F in the direction vertical to the direction of the CNT fibers F running. With this unique structure, a resistive force is exerted on the CNT fibers F against the running when the aggregating unit 3 aggregates the CNT fibers F. For this reason, the CNT fibers F thus are twisted densely in the twisting and winding device 5.

In the yarn producing apparatus 1, the aggregating unit 3 aggregates the CNT fibers F while causing the CNT fibers F to pass through the through hole 11 in contact with the through hole 11 thus exerting force on the CNT fibers F in the direction vertical to the direction of the CNT fibers F running. With this unique structure, exertion of a resistive force on the CNT fibers F and aggregation of the CNT fibers F are accomplished with a simple structure.

In the yarn producing apparatus 1, the adjusting mechanism 10 adjusts the aggregation state of the CNT fibers F by adjusting the positional relation between the first plate-shaped member 12 and the second plate-shaped member 13 and adjusting the opening area of the through hole 11. With this unique structure, the magnitude of a resistive force exerting on the CNT fibers F and the aggregation state of the CNT fibers F are able to be adjusted as desired. For example, even when the CNT fibers F clog the through hole 11, the CNT fibers F are easily removed by increasing the distance between the first plate-shaped members 12 and the second plate-shaped members 13.

In the yarn producing apparatus 1, the adjusting mechanism 10 adjusts the opening area of the through hole 11 by moving the first plate-shaped member 12 and the second plate-shaped member 13 and adjusting the overlapping state of the first notch 16 and the second notch 17. With this unique structure, the opening area of the through hole 11 is able to be adjusted easily and reliably. The adjusting mechanism 10 may adjust the overlapping state of the first notch 16 and the second notch 17 by moving the first plate-shaped member 12 or the second plate-shaped member 13.

The yarn producing apparatus 1 includes the tensioning unit 4 that applies tension to the CNT fibers F running between the aggregating unit 3 and the twisting and winding device 5. With this unique structure, tension at a desired value is applied to the CNT fibers F, and the CNT fibers F are twisted more densely in the twisting and winding device 5.

In the yarn producing apparatus 1, a pneumatic tensioning mechanism is used as the tensioning unit 4. With this unique structure, tension is stably applied to the CNT fibers F without aggregating the CNT fibers F more than necessary due to contact.

The yarn producing apparatus 1 also includes the substrate support 2 that supports the CNT forming substrate S from which the CNT fibers F are drawn. With this unique structure, the CNT fibers F are stably supplied.

In the twisting and winding device 5 in the yarn producing apparatus 1, the guide 31 that guides the CNT yarn Y to the winding tube T is rotated around the winding tube T, such that the CNT fibers F are twisted and CNT yarn Y is produced while causing the CNT fibers F, CNT yarn Y, or both to swirl. With this unique structure, the CNT fibers F, CNT yarn Y, or both swirl and a balloon B is formed. While the balloon appropriately absorbs tension variations produced in the relatively less elastic CNT fibers F, the CNT fibers F are twisted efficiently. In the foregoing preferred embodiment, the CNT yarn Y is produced by twisting the CNT fibers F while forming a balloon B. Alternatively, the CNT yarn Y may be produced by twisting the CNT fibers F in a condition under which no balloon B is formed.

Although a preferred embodiment of the present invention has been described above, the present invention is not intended to be limited to the foregoing preferred embodiment. For example, the supply source of the CNT fibers F may not be a CNT forming substrate S but may be a device that continuously synthesizes carbon nanotubes to supply the CNT fibers F. The twisting and winding device 5 may be replaced by, for example, a device that gives false twist to CNT fibers F and a device that winds the false-twisted CNT yarn around the winding tube.

Figure 6:
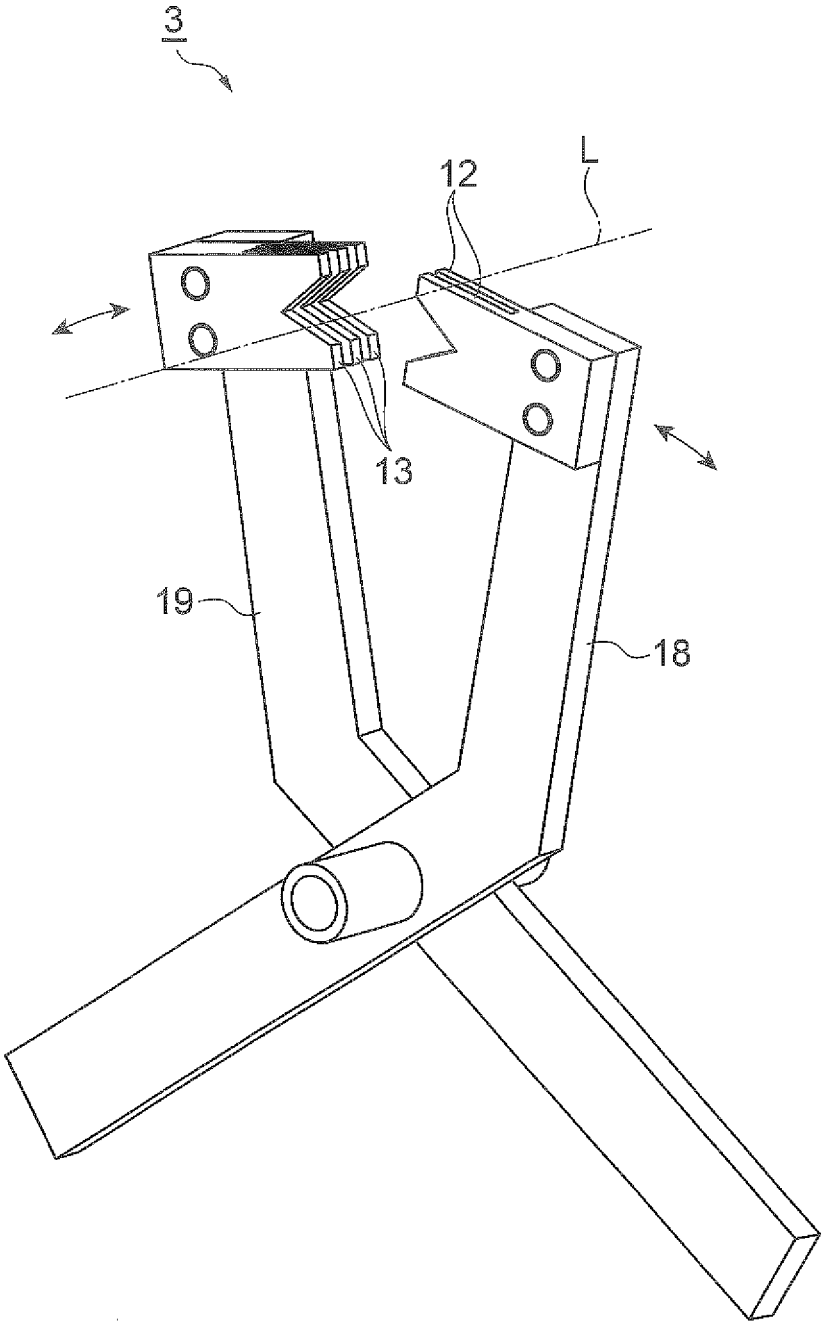
FIG. 6 is a perspective view of a modification to the aggregating unit in the yarn producing apparatus in FIG. 1.

As shown in FIG. 6, the first plate-shaped members 12 and the second plate-shaped members 13 may be attached to a holding piece 18 and a holding piece 19, respectively. The holding piece 18 and the holding piece 19 swing about a line parallel or substantially parallel to the predetermined line L. In this case, the holding piece 18 and the holding piece 19 are swung in directions different from each other, so that the tip end portion 12*a* of each first plate-shaped member 12 and the tip end portion 13*a* of each second plate-shaped member 13 are able to be advanced and retreated to/from the predetermined line L.

Figure 7:
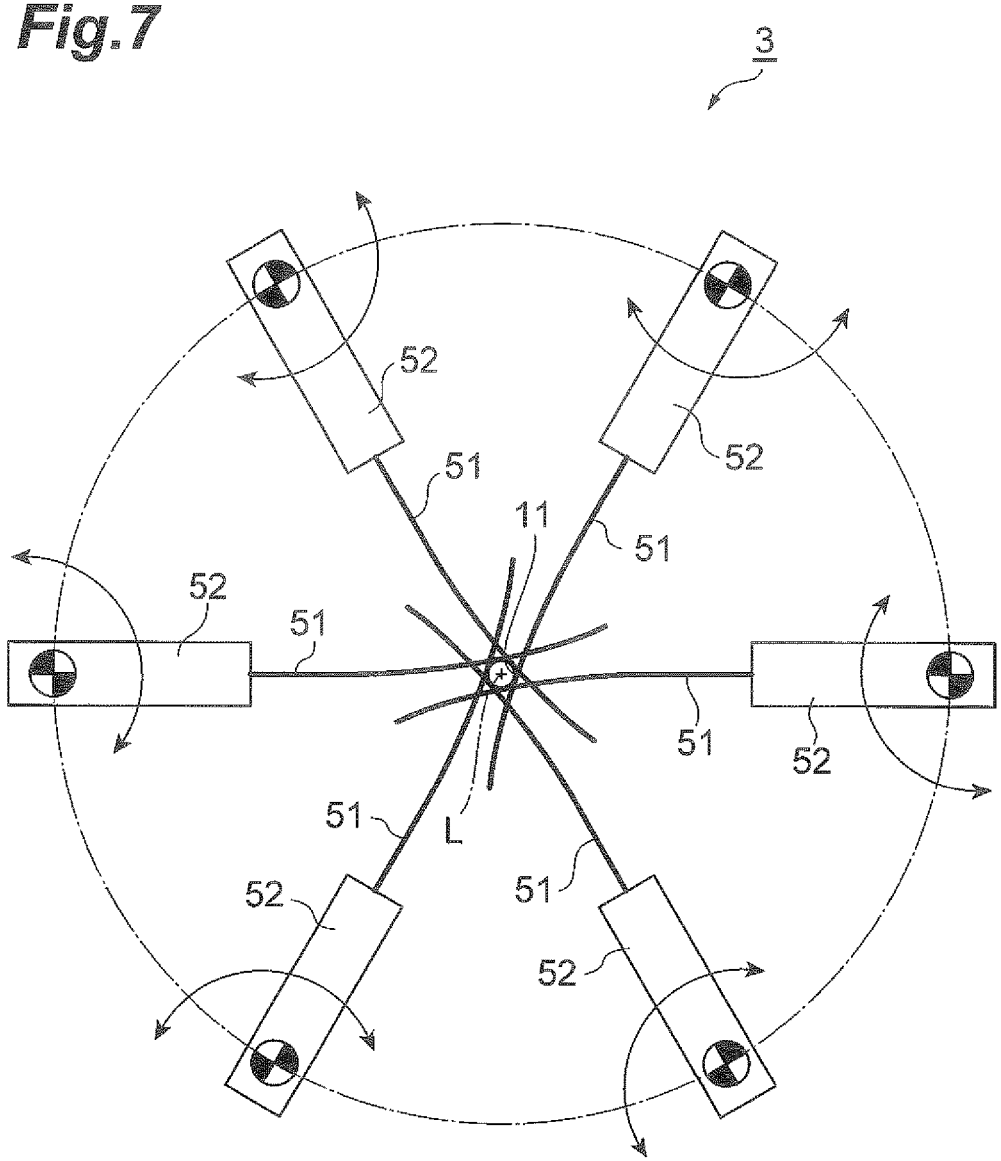
FIG. 7 is a front view of a modification to the aggregating unit in the yarn producing apparatus in FIG. 1.

As shown in FIG. 7, the aggregating unit 3 may include a plurality of wires 51 and a plurality of holding pieces 52 as assembly parts that define the through hole 11 that causes the CNT fibers F to pass through in contact with the through hole 11. The wires 51 define the through hole 11. The holding pieces 52 hold the respective ends of the wires 51. The adjusting mechanism 10 may adjust the opening area of the through hole 11 by swinging the holding pieces 52 and thus adjusting the overlapping state of the wires 51. Also in this case, the opening area of the through hole 11 is able to be adjusted easily and reliably. The centers about which the holding pieces 52 are swung are arranged at regular pitches on the same circle the center of which is on the predetermined line L.

The yarn producing apparatus 1 may further include an additional aggregating unit that additionally aggregates the CNT fibers F running between the aggregating unit 3 and the twisting and winding device 5. The additional aggregating unit more densely aggregates the CNT fibers F aggregated by the aggregating unit 3 to such an extent that the CNT fibers F are able to be twisted in the subsequent stage. This unique structure causes the CNT fibers F to be aggregated step by step thus significantly reducing or preventing strain on the CNT fibers F and disturbance in alignment (arrangement) of the CNT fibers F.

A thin tube is used as the additional aggregating unit. The thin tube is shaped like a circular tube having a downstream end tapered to the downstream side. The tapered end of the thin tube includes a through hole that the CNT fibers F pass through in contact with the through hole. The thin tube further aggregates the CNT fibers F while exerting a resistive force on the CNT fibers F against the running when the CNT fibers F aggregated by the aggregating unit 3 run toward the twisting and winding device 5. With this unique structure, exertion of a resistive force on the CNT fibers F and aggregation of the CNT fibers F are accomplished with a simple structure.

Various preferred embodiments of the present invention provide a yarn producing apparatus capable of producing carbon nanotube yarn with sufficient strength and an aggregating unit applicable to the yarn producing apparatus.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A yarn producing apparatus for producing carbon nanotube yarn from carbon nanotube fibers while causing the carbon nanotube fibers to run, the yarn producing apparatus comprising:

an aggregator that aggregates the carbon nanotube fibers such that the carbon nanotube fibers are in contact with each other; and a twister that twists the carbon nanotube fibers aggregated by the aggregator; wherein the aggregator includes a first plate provided with a first notch and a second plate provided with a second notch, the first notch and the second notch together defining a through hole;

the aggregator includes a biasing member that adjusts an aggregation state of the carbon nanotube fibers by adjusting a positional relation between the first plate and the second plate to adjust an opening area of the through hole.

2. The yarn producing apparatus according to claim 1, wherein the aggregator aggregates the carbon nanotube fibers while exerting a force on the carbon nanotube fibers in a direction perpendicular to a direction in which the carbon nanotube fibers running.

3. The yarn producing apparatus according to claim 2, wherein the aggregator aggregates the carbon nanotube fibers while exerting the force on the carbon nanotube fibers by causing the carbon nanotube fibers to pass through the through hole in contact with the through hole.

4. The yarn producing apparatus according to claim 1, wherein the biasing member adjusts the opening area of the through hole by moving at least one of the first plate and the second plate to adjust overlapping state of the first notch and the second notch.

5. The yarn producing apparatus according to claim 1, further comprising a tensioner that acts on the carbon nanotube fibers running between the aggregator and the twister and applies tension to the carbon nanotube fibers to be twisted by the twister.

6. The yarn producing apparatus according to claim 5, wherein the tensioner includes a pneumatic tensioner that blows air to the carbon nanotube fibers to exert a force on the carbon nanotube fibers in a direction opposite to a direction in which the carbon nanotube fibers run.

7. The yarn producing apparatus according to claim 5, wherein the tensioner includes a gate tensioner that bends the carbon nanotube fibers by using comb tooth-shaped contact portions arranged alternately to exert a resistive force on the running carbon nanotube fibers.

8. The yarn producing apparatus according to claim 1, further comprising an additional aggregator between the aggregator and the twister and that aggregates the running carbon nanotube fibers.

9. The yarn producing apparatus according to claim 1, further comprising a substrate support that supports a carbon nanotube forming substrate from which the carbon nanotube fibers are drawn.

10. The yarn producing apparatus according to claim 1, wherein the twister includes:

a wind driver that causes a winding shaft provided with a winding tube to rotate about a winding centerline of the winding shaft to wind the carbon nanotube yarn onto the winding tube;

a twist driver that causes a guide to rotate around the winding tube and guide the carbon nanotube yarn to the winding tube, to twist the carbon nanotube fibers and produce the carbon nanotube yarn while causing the carbon nanotube fibers, the carbon nanotube yarn, or both of the carbon nanotube fibers and the carbon nanotube yarn, to swirl; and a traverse driver that causes the guide to reciprocate relative to the winding tube along the winding centerline of the winding shaft to cause the carbon nanotube yarn to traverse the winding tube.

11. The yarn producing apparatus according to claim 1, wherein the biasing member includes a spring that adjusts the positional relation between the first plate and the second plate.

12. The yarn producing apparatus according to claim 1, wherein the biasing member includes a first holding piece and a second holding piece;

the first holding piece is attached to the first plate;

the second holding piece is attached to the second plate; and the first holding piece and the second holding piece swing about an axis, and in directions different from each other, so as to adjust the positional relation between the first plate and the second plate.

13. A yarn producing apparatus for producing carbon nanotube yarn from carbon nanotube fibers while causing the carbon nanotube fibers to run, the yarn producing apparatus comprising:

an aggregator that aggregates the carbon nanotube fibers such that the carbon nanotube fibers ae in contact with each other; and a twister that twists the carbon nanotube fibers aggregated by the aggregator; wherein the aggregator includes a plurality of wires and a plurality of holding pieces, the wires defining a through hole, and the holding pieces holding respective ends of the wires; and an aggregation state of the carbon nanotube fibers is adjusted by swinging each of the holding pieces and adjusting an overlapping state of the wires to adjust an opening area of the through hole.

14. An aggregator, in a yarn producing apparatus for producing carbon nanotube yarn from carbon nanotube fibers while causing the carbon nanotube fibers to run, that aggregates the carbon nanotube fibers such that the carbon nanotube fibers are in contact with each other, the aggregator comprising:

a first plate provided with a first notch and a second plate provided with a second notch, the first notch and the second notch together defining a through hole; and a biasing member that adjusts an aggregation state of the carbon nanotube fibers by adjusting a positional relation between the first plate and the second plate to adjust an opening of the through hole.

15. The aggregator according to claim 14, wherein the aggregator aggregates the carbon nanotube fibers while exerting a force on the carbon nanotube fibers in a direction perpendicular to a direction in which the carbon nanotube fibers run.

16. The aggregator according to claim 15, wherein the aggregator aggregates the carbon nanotube fibers while exerting the force on the carbon nanotube fibers by causing the carbon nanotube fibers to pass through the through hole in contact with the through hole.

17. The aggregator according to claim 14, wherein the biasing member adjusts the opening area of the through hole by moving at least one of the first plate and the second plate to adjust an overlapping state of the first notch and the second notch.

18. The aggregator according to claim 14, wherein the biasing member includes a spring that adjusts the positional relation between the first plate and the second plate.

19. The aggregator according to claim 14, wherein the biasing member includes a first holding piece and a second holding piece;

the first holding piece is attached to the first plate;

the second holding piece is attached to the second plate; and the first holding piece and the second holding piece swing about an axis, and in directions different from each other, so as to adjust the positional relation between the first plate and the second plate.

20. An aggregator, in a yarn producing apparatus for producing carbon nanotube yarn from carbon nanotube fibers while causing the carbon nanotube fibers to run, that aggregates the carbon nanotube fibers such that the carbon nanotube fibers are in contact with each other, the aggregator comprising:

a plurality of wires and a plurality of holding pieces, the wires defining a through hole, and the holding pieces holding respective ends of the wires; wherein an aggregation state of the carbon nanotube fibers is adjusted by swinging each of the holding pieces and adjusting an overlapping state of the wires to adjust an opening area of the through hole.

* * * * *